United States Patent [19]

Shibata et al.

[11] 3,988,235

[45] Oct. 26, 1976

[54] VERTICAL DIAPHRAGM TYPE ELECTROLYTIC APPARATUS FOR CAUSTIC SODA PRODUCTION

[75] Inventors: Hiroshi Shibata; Isao Okazaki; Yoshikazu Kokubu, all of Iwaki, Japan

[73] Assignee: Kureha Kagaku Kogyo Kabushiki Kaisha, Tokyo, Japan

[22] Filed: July 16, 1975

[21] Appl. No.: 596,447

[30] Foreign Application Priority Data

July 26, 1974 Japan ..... 49-85644
July 30, 1974 Japan ..... 49-87140

[52] U.S. Cl. ..... 204/266; 204/94; 204/128; 204/258; 204/269; 204/270; 204/278

[51] Int. Cl.[2] ..... C25B 1/26; C25B 15/08

[58] Field of Search ..... 204/95, 98, 101, 128, 204/129, 258, 266, 270, 275, 278, 94, 269

[56] References Cited

UNITED STATES PATENTS

| | | | |
|---|---|---|---|
| 998,982 | 7/1911 | Pier | 204/95 |
| 1,819,917 | 8/1931 | Niederreither et al. | 204/129 |
| 3,410,770 | 11/1968 | Buechler | 204/129 |

*Primary Examiner*—John H. Mack
*Assistant Examiner*—A. C. Prescott
*Attorney, Agent, or Firm*—Flynn & Frishauf

[57] ABSTRACT

An improvement on the known brine-chlorine gas separating vessel disposed on the anode chambers of a vertical diaphragm type electrolytic cell for caustic soda production by connecting said brine-chlorine gas separating vessel to a secondary brine-chlorine gas separating vessel through a chlorine gas pipe and a brine pipe, and connecting the secondary brine-chlorine gas separating vessel to a tertially brine-chlorine gas separating vessel similarly through a chlorine gas pipe and a brine pipe.

10 Claims, 6 Drawing Figures

VERTICAL DIAPHRAGM TYPE ELECTROLYTIC APPARATUS FOR CAUSTIC SODA PRODUCTION

This invention relates to a vertical diaphragm type electrolytic apparatus for electrolyzing brine, and more particularly to an improvement on an electrolytic apparatus in which a brine-chlorine gas separating vessel for separting chlorine gas from the scattered particles of brine contained therewith is disposed on the anode chamber or chambers of the vertical diaphragm type electrolytic cell.

It is known that, with a diaphragm type brine electrolytic cell, raw brine is continuously brought into the anode chamber, in which chlorine gas is evolved as by-product. Where chlorine gas is evolved in a small amount per unit area of the anode surface and chlorine gas is fully separated in the anode chamber, then the position of the raw brine inlet of the anode chamber and that of the chlorine gas outlet thereof can be freely designed. In some cases, a single pipe can be made to act concurrently as a raw brine inlet and a chlorine gas outlet. However, a recent trend to adopt a bipolar or multiple vertical diaphragm type electrolytic cell and in consequence development of a technique of prominently increasing the evolution of chlorine gas per unit floor area of an electrolytic cell have resulted in the difficulty of fully separating chlorine gas from raw brine, causing a large amount of scattered particles of brine to be contained with chlorine gas evolved from the anode chamber and discharged out of the electrolytic cell. To avoid such difficulties, a device has been attempted firstly to separate chlorine gas from the anolyte in order to draw only chlorine gas out of the cell and reflux the separated anolyte into the anode chamber. The invention of U.S. Pat. No. 3,337,443 sets forth a means of installing a brine-chlorine gas separating vessel having its bottom bored with a number of holes on the anode chamber of bipolar electrolytic cell, causing chlorine gas containing scattered particles of anolyte to bubble up from the anolyte accumulating bottom space of said vessel communicating with the chlorine gas accumulating space of anode chamber through said bottom holes in order to separate naturally the chlorine gas and the anolyte particles in the vessel. The separated particles accumulate into the bottom liquid phase in the vessel, and said bottom liquid flows down gradually into the anode chamber through the bottom holes of the vessel. (Refer to FIG. 20 appended to U.S. Pat. No. 3,337,443.)

Further, according to the above-mentioned U.S. patent, the head pressure of anolyte accumulated in the vessel is applied to the chlorine gas collected in the anode chamber, thereby playing the part of promoting the permeation of brine through the diaphragm with a difference between the heads of anolyte and catholyte used as an aid to supply additional pressure.

Where, however, an unduly large amount of chlorine gas bubbles up through the anolyte accumulated in the vessel, the so-called flooding phenomenon takes place and the level of said accumulated anolyte in the vessel prominently sways, causing the pressure applied to the chlorine gas accumulated in the anode chamber to vary noticeably. As the result, streams of brine permeating through the diaphragm take irregular courses, and, in extreme case, temporarily stop or partly run backward, leading to the unstable operation of electrolysis and a considerable drop in the current efficiency thereof.

The present inventors previously discovered that the above-mentioned difficulties could be eliminated to some extent by connecting the chlorine gas accumulating spaces of the anode chamber and that of the brine-chlorine gas separating vessel by at least one gas rising pipe, and refluxing the electrolyte accumulated in said separating vessel to the anode chamber through another down stream pipe communicating with said vessel. (Refer to FIG. 6 appended to this specification.)

It was further disclosed that, for elevation of pressure in the chlorine gas accumulating space of the separating vessel and in consequence additional pressure in the chlorine gas accumulating space of the anode chamber, it was preferred to provide a secondary brine-chlorine gas separating vessel, whose brine accumulating space communicated with that of the primary brine-chlorine gas separating vessel through a liquid-flow pipe, and the end part of the chlorine gas outlet pipe of the primary vessel was inserted into the brine accumulating space of the secondary vessel, causing chlorine gas drawn out of the primary vessel to bubble through the phase of brine accumulated in the secondary vessel to be later discharged therefrom. (This secondary vessel is illustrated in FIGS. 1 and 5.) Since, however, chlorine gas was made to bubble through the phase of brine phase in the secondary vessel, the undulatory fluctuation of the liquid phase of secondary vessel unavoidably gave rise to slight changes in the head pressure of brine collected in the secondary vessel.

The object of this invention is to carry out a very efficient electrolytic operation by substantially eliminating fluctuation in the above-mentioned head pressure of anolyte in the anode chamber.

SUMMARY OF THE INVENTION

This object is attained by connecting the secondary vessel with a tertiary brine-chlorine gas separating vessel of the tower type.

To describe in greater detail, the vertical diaphragm type electrolytic apparatus of this invention comprises 1. a vertical diaphragm type electrolytic cell;

2. a primary brine-chlorine gas separating vessel disposed on the electrolytic cell (1) and provided with a chlorine gas accumulating upper space connected to the chlorine gas accumulating space of anode chamber through a chlorine gas flow-up pipe attached therebetween, a brine accumulating lower space having a brine flow-down pipe of suitable diameter fitted to the bottom of said separating vessel so as to keep the level of brine accumulated in said space substantially constant, and a raw brine inlet pipe communicated with said brine accumulating lower space;

3. a secondary brine-chlorine gas separating vessel connected to the primary vessel and including a chlorine gas accumulating upper space connected to the chlorine gas accumulating upper space of the primary separating vessel through a chlorine gas-flow pipe and a brine accumulating lower space connected to the brine accumulating lower space of the primary separating vessel through a brine flow-pipe, the forward end portion of said chlorine gas-flow pipe being dipped into the phase of brine accumulated in the secondary separating vessel; and 4. a tertiary tower type brine-chlorine gas separating vessel connected to the secondary separating vessel and including consisting of a chlorine gas accumulating upper space connected to the chlorine gas accumulating space of the secondary separating vessel through at least one obliquely rising flushing pipe and a brine accumulating lower space connected to the brine accumulating lower space of the secondary separating vessel through at least one brine-flow pipe, and a chlorine gas outlet provided at the top of the tertiary separating vessel.

DETAILED DESCRIPTION

Figure 1:
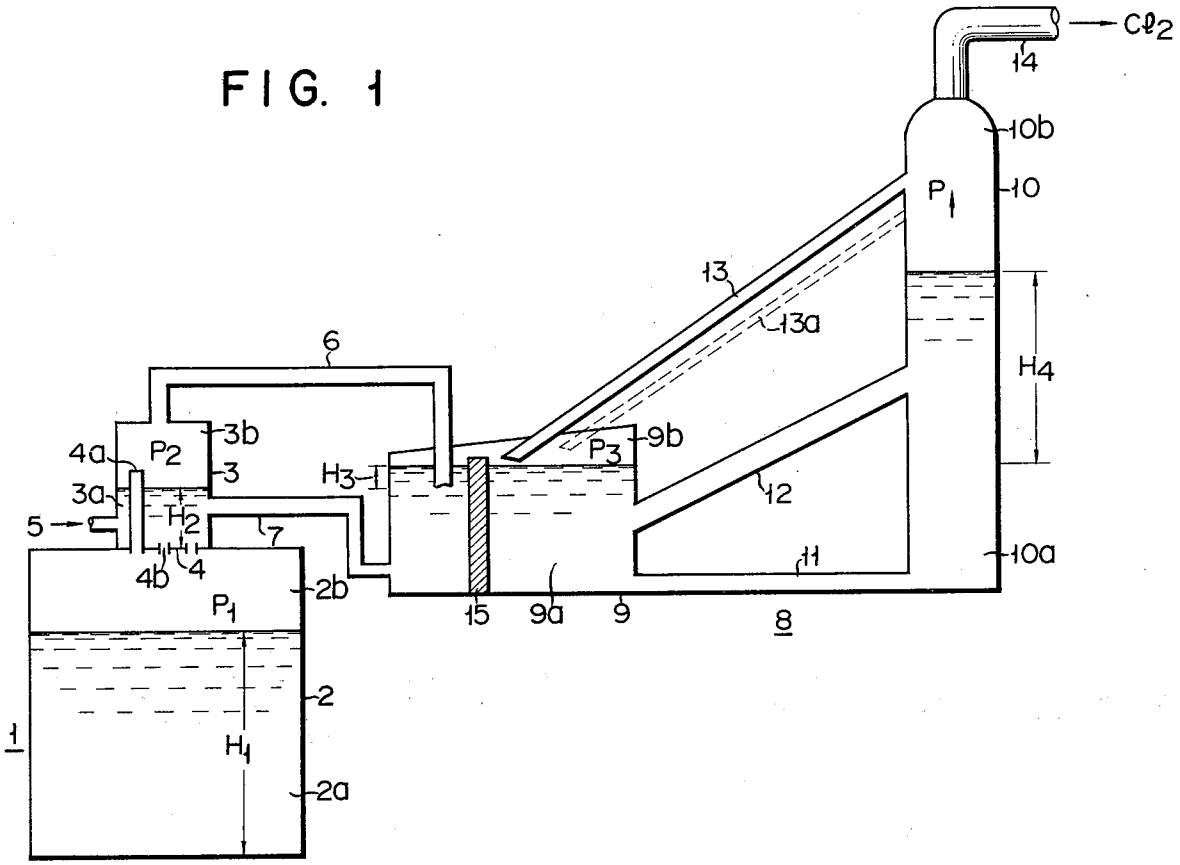
FIG. 1 is a schematic vertical sectional view of an apparatus according to an embodiment of this invention.
Figure 6:
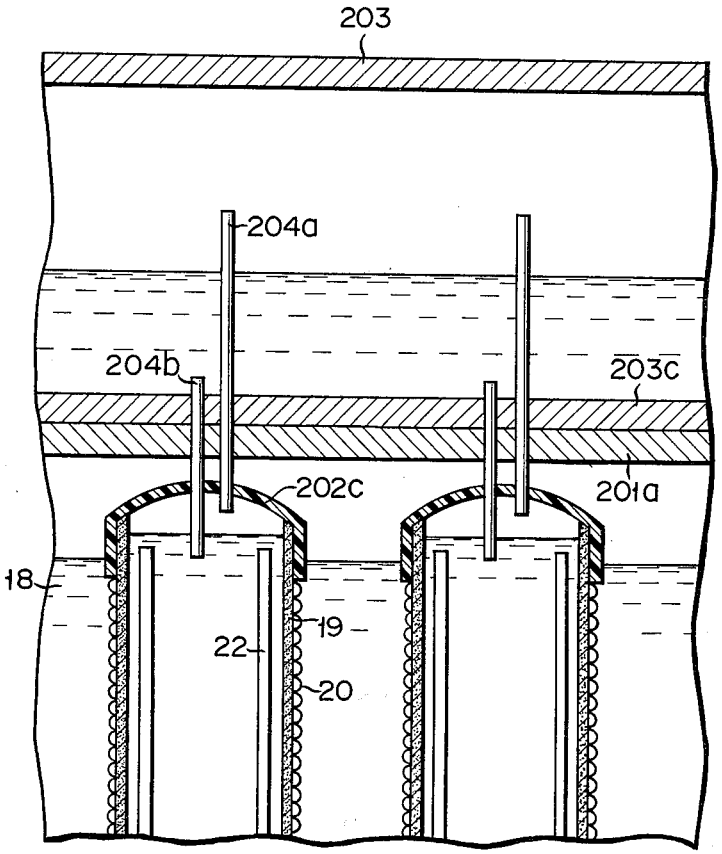
FIG. 6 is a fractional longitudinal sectional view of FIG. 5.

There will be described by reference to FIG. 1 the detail of this invention. A primary brine-chlorine gas separating vessel 3 is set on the anode chambers 2 of a vertical diaphragm type electrolytic cell 1. A chlorine gas rising pipe 4*a* is provided so as to penetrate a partition wall 4 placed between the anode chamber 2 of the cell 1 and the primary vessel 3. A brine reflux hole or pipe 4*b* is provided so as to penetrate the partition wall 4. Referential numerals 5 and 6 denote a raw brine inlet and a chlorine gas outlet pipe respectively. It is not always necessary to provide only one chlorine gas rising pipe 4*a* but it is possible to use a plurality thereof. The lower end of the brine reflux pipe 4*b* may be opened to the chlorine gas accumulating space 2*b* of the anode chamber 2, or be dipped in the anolyte 2*a* as seen in FIG. 6. The partition wall 4 of FIG. 1 concurrently constitutes part of the ceilings of anode chambers 2 and part of the bottom plate of the primary brine-chlorine separating vessel 3. From the standpoint of safety, it is advised to fit the raw brine inlet 5 to the primary vessel 3 as shown in FIG. 1. In some cases, however, raw brine may be directly brought into the anode chamber 2.

This invention is characterized in that an automatic brine and chlorine gas pressures controlling device 8 formed by combining a secondary brine-chlorine gas separating vessel 9 with a tertiary tower type brine-chlorine gas separating vessel 10 is connected to the primary brine-chlorine gas separating vessel 3. The tip of the forward end portion of the chlorine gas pipe 6 whose rear end is fitted to the chlorine gas accumulating space 3*b* of the primary brine-chlorine gas separating vessel 3 is slightly dipped into a brine held in the brine accumulating space 9*a* of the secondary vessel 9. The brine accumulating space 3*a* of the primary vessel 3 is connected to the brine accumulating space 9*a* of the secondary vessel 9 through a brine connection pipe 7. The chlorine gas accumulating space 9*b* of the secondary vessel 9 and the chlorine gas accumulating space 10*b* of the tertiary tower type vessel 10 communicate with each other through an obliquely rising flush pipe 13. The brine accumulating spaces 9*a* and 10*a* of the secondary and tertiary vessels 9 and 10 communicate with each other through a brine connection pipe 11.

It is not always necessary to provide only one flush pipe 13 and only one brine connection pipe 11 but it is possible to provide both pipes 13 and 11 in combination, using, for example, pipes 13*a* and 12 as respective auxiliaries as shown in FIG. 1. Referential numeral 14 is a chlorine gas outlet of the tower type tertiary separating vessel 10.

A small baffle plate 15 erected in the secondary vessel 9 is intended to prevent the particles of brine scattered by ejected chlorine gas near the tip of the forward end portion of the chlorine gas pipe 6 from being thrown into the flush pipe 13. Where, however, this event is little likely to take place, it is obviously unnecessary to provide said baffle plate 15.

The tip of the forward end portion of the chlorine gas pipe 6 inserted into the brine accumulating space 9*a* of the secondary separating vessel 9 is chosen to have the same height as the level of liquid in the brine accumulating space 3*a* of the primary separating vessel 3.

The chlorine gas evolved in the anode chamber 2 and accompanied by scattered particles of anolyte passes through the chlorine gas outlet riser 4*a* of the primary separating vessel 3. The particles of anolyte entrained with the evolved chlorine gas are separated from said gas by gravitation in the chlorine gas accumulating space 3*b* to be fallen on the surface of brine accumulating space 3*a*. The chlorine gas now stripped of the particles of anolyte is conducted through the chlorine gas pipe 6 into the secondary brine-chlorine gas separating vessel 9. On the other hand, the separated particles of anolyte are brought into the brine accumulating space 3*a*, and then are refluxed down into the anode chamber 2 to maintain the brine level in the primary separating vessel 3 as required. The forward end portion of the chlorine gas pipe 6 is slightly dipped into the brine accumulated in the secondary separating vessel 9 so as to allow chlorine gas continuously to eject from said chlorine gas pipe 6. At this time, the chlorine gas is blown on to the surface of the accumulated liquid space 9*a* partly depressed by the pressure of said gas instead of bubbling therethrough, and flows through the obliquely rising flush pipe 13 in a state again accompanied by scattered particles of brine into the chlorine gas accumulating space 10*b* of the tertiary tower-type separating vessel 10 to be stripped of the scattered particles of brine. Then the chlorine gas is drawn out of the electrolytic system through the chlorine gas outlet 14.

In the flush pipe 13, the particles of brine scattered from the surface of accumulated liquid in the brine accumulating space 9*a* of the secondary separating vessel 9 are separated from the chlorine gas and run down in said flush pipe 13. Therefore, vigorous brushing takes place between the upward flowing chlorine gas and the downward running brine, giving rise to a prominent pressure drop of chlorine gas in the flush pipe 13. The particles of brine separated from chlorine gas in the chlorine gas accumulating space 10*b* unite with the brine 10*a* already accumulated in the tertiary separating vessel 10. The accumulated brine 10*a* now increased in volume runs back to the brine accumulating space 9*a* of the secondary separating vessel 9 through the brine connection pipe 11 and/or 12, and finally to the anode chambers 2 through the brine connection pipe 7 and the brine accumulating space 3*a* of the primary separating vessel 3.

There will now be described the principle by which a constant level of pressure is automatically maintained in the chlorine gas accumulating space of the anode chamber 2. Referring to FIG. 1, the anode chamber 2 substantially consists of a brine accumulating space 2*a* and a chlorine gas accumulating space 2*b*. Now let the height of the brine in the brine accumulating space 2*a* of anode chamber 2 be designated by $H_1$ and the pressure occurring in the chlorine gas accumulating space 2*b* thereof be represented by $P_1$. For briefness of description, let it be further assumed that throughout the subject brine electrolyzing system, the liquid phase of brine is at the same concentration and consequently has the same density, and that the pressure of the phase of chlorine gas is defined by being converted into the corresponding head of brine. The bottom of the brine accumulating space 2*a* is impressed not only with the head pressure $H_1$ of brine but also with the pressure $P_1$ of chlorine gas held in the chlorine gas accumulating space 2*b* lying on said brine phase 2*a*. These pressures overcome the head pressure of brine held in the brine accumulating space of the cathode chamber (not shown in FIG. 1), the pressure of hydrogen gas held in the hydrogen gas accumulating space of said cathode chamber and the resistance of the diaphragm to permeation of brine therethrough, causing brine to run from the anode chamber 2 to the cathode chamber.

With $H_2$ taken to denote the head of brine received in the brine accumulating space 3*a* of the primary separating vessel 3, $P_2$ taken to present the pressure of chlorine gas received in the chlorine gas accumulating space 3*b* of said vessel and $\Delta P_2$ taken to indicate a value of pressure resisting the upward flow of chlorine gas through the chlorine gas outlet riser 4*a*, then the following equation results:

$$P_1 = P_2 + \Delta P_2$$

With $H_3$ taken to denote the depth of the tip of the downward bent forward end portion of the chlorine gas pipe 6 inserted into the brine held in the brine accumulating space 9*a* of the secondary separation vessel 9 as measured from the level of said brine, and $P_3$ taken to denote the pressure of chlorine gas received in the chlorine gas accumulating space 9*b*, then the following equation is obtained:

$$P_2 = P_3 + H_3$$

The tip of the above-mentioned downward bent forward end portion of the chlorine gas pipe 6 and the level of brine received in the brine accumulating space 3*a* have substantially the same height. In this case, it is assumed that the chlorine gas pipe has a large diameter and the pressure drop in said pipe can be neglected.

With $H_4$ taken to denote a difference between the levels of brine received in the brine accumulating spaces 10*a* and 9*a*, and $P_4$ taken to denote the pressure of chlorine gas held in the chlorine gas accumulating space 10*b* of the tertiary separating vessel 10, then the following equation is established:

$$P_3 = P_4 + H_4$$

Further, pressure resistance of the upward flow of chlorine gas through the obliquely rising flush pipe 13 has a value substantially coinciding that of $H_4$. Thus results the following equation:

$$P_1 = \Delta P_2 + H_3 + H_4 + P_4$$

Now let it be assumed that hydrogen gas released from the cathode chamber is expelled by the above-defined pressure $P_4$, and the catholyte and anolyte are made to have substantially the same level. A slight pressure difference $\Delta P$ between the levels of brine received in the anode and cathode chambers may be expressed as follows:

$$\Delta P = \Delta P_2 + H_3 + H_4$$

Since a larger amount of brine generally has to be supplied from the anode chamber 2 to the cathode chamber in order to elevate the electrolyzing current, said supply must be effected by applying higher differential pressure $\Delta P$. According to the system of this invention, increased electrolyzing current leads to the larger evolution of chlorine gas and in consequence the higher pressure resisting the upward flow of chlorine gas through the oblique rising flush pipe 13. As the result, $P_3$ and $H_4$ increase to attain the automatic control of the pressure $P_1$ of chlorine gas held in the chlorine gas accumulating space 2*b* of the anode chamber 2. Since, therefore, little change occurs in $H_1$, it is unnecessary to provide any excess free space in the anode and cathode chambers.

If, in the above-mentioned case, only a pressure difference between the levels of brine received in both anode and cathode chambers is taken into account, then it may be considered to make the level $H_2$ correspond to $\Delta P_2 + H_3 + H_4$ as is described in the previously mentioned U.S. Pat. No. 3,337,443. If, however, brine held in the brine accumulating space 3*a* of the primary separating vessel 3 disposed on the electrolytic cell is made to have the above-mentioned level, then the level of the brine received in said space 3*a* prominently sways.

Figure 2:
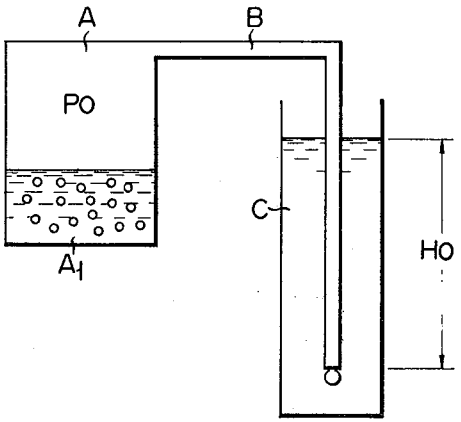
FIG. 2 is a schematic vertical sectional view generally arranged for flowing gas into liquid.

There will be described the reason of the above by reference to FIG. 2 schematically illustrating an ordinary gas generator. Now let it be assumed that gas is continuously evolved from the liquid phase $A_1$ of said gas generator A, and passes through a gas pipe B and then the liquid phase of a cylinder C into the open air. With $P_0$ taken to denote the pressure of gas held in the gas accumulating space of the gas generator A and $H_0$ taken to represent the depth of the tip of gas pipe B inserted into the liquid phase of the cylinder C as measured from the surface of said liquid phase, then the gas pressure balances with a pressure represented by the liquid head $H_0$ at the tip of the forward end portion of the gas pipe B in case of $P_0 = H_0$, causing a gas bubble still stick to said tip.

In case of $P_0 = H_0 + \Delta P_0$, however, the gas bubble is released from the tip of said gas pipe B. $\Delta P_0$ denotes the pressure of gas by which it floats up through the liquid phase in the cylinder C against the interface tension between the liquid and the gas at the tip of the gas pipe B. This gas pressure $\Delta P_0$ is related to the viscosity of the liquid held in the cylinder C, liquid pressure applied to the tip of the forward end portion of the gas pipe B, and an interface tension between gas and the inner wall of the gas pipe B as well as between the gas and liquid. The moment a gas bubble is removed from the tip of the gas pipe B, the liquid pressure applied to said tip prominently decreases momentarily by the buoyancy of the gas bubble, causing the succeeding gas bubbles to follow the first one. As the result, the gas pressure in the gas pipe B falls by that extent. With the gas generator of the above-mentioned construction, therefore, the discharge of a large amount of gas is generally repeated intermittently, giving rise to noticeable fluctuations in the level of liquid contained in the cylinder C, and in consequence prominent changes in the pressure $P_0$ of gas held in the gas generator A.

With the electrolytic apparatus of this invention, however, the chlorine gas accumulating space 2*b* of the anode chamber 2 communicates with the chlorine gas accumulating space 3*b* of the primary brine-chlorine gas separating vessel 3 through the chlorine gas outlet riser 4*a* as mentioned before. Therefore, chlorine gas flows without bubbling from the anode chamber 2 to the chlorine gas accumulating space 3*b* of the primary separating vessel 3. Since the tip of the forward end portion of the chlorine gas pipe 6 is only slightly dipped into the brine received in the brine accumulating space 9*a* of the secondary separating vessel 9, said tip has a very small depth $H_3$ as measured from the surface level of the brine. Further, as previously mentioned, the brine level immediately below the tip of the forward end portion of the chlorine gas pipe 6 is depressed, as soon as chlorine gas begins to be released from said tip, admitting of the continuous discharge of chlorine gas. In this case, therefore, chlorine gas does not present intermittent bubbling.

Further, since the chlorine gas accumulating space 9*b* of the secondary separating vessel 9 communicates with the chlorine gas accumulating space 10*b* of the tertiary separating vessel 10 through the obliquely rising flush pipe 13, no bubbling of chlorine gas appears in said tertiary separarting vessel either. Even if a sharp change takes place in the flow rate of chlorine gas in the flush pipe 13 and consequently in $P_3$, the brine head $H_4$ balancing with said $P_3$ is difficult to be subjected to a sudden change due to inertia. Therefore, the pressure $P_2$ occurring in the chlorine gas pipe 6 in which chlorine gas quickly flows by inertia is neither subjected to any abnormal fluctuation. Accordingly, the pressure $P_1$ of chlorine gas held in the chlorine gas accumulating space of the anode chamber remains substantially fixed as expressed by the equation $P_1 = P_4 + H_4 + H_3 + \Delta P_2$, thus enabling chlorine gas to be discharged without affecting the pressure of chlorine gas received in the chlorine gas accumulating space 2*b* of the anode chamber 2, with the pressures of chlorine gas held in the various chlorine gas accumulating spaces balanced as required.

Figure 3:
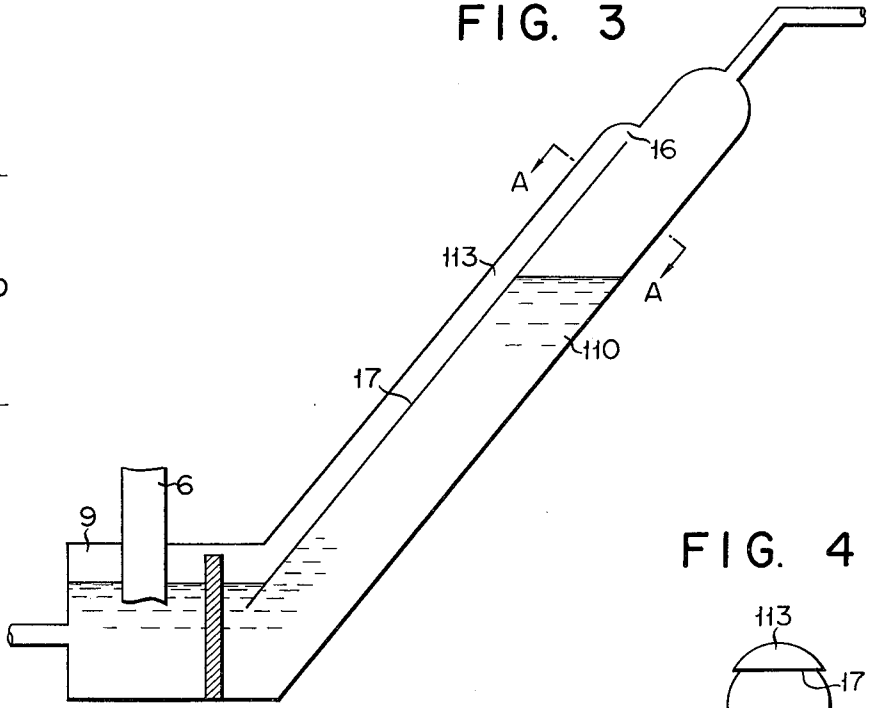
FIG. 3 is a schematic vertical sectional view of an automatic pressure control device used with an apparatus according to another embodiment of this invention.
Figure 4:
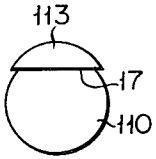
FIG. 4 is a sectional view on line A—A of FIG. 3.

There will be described by reference to FIGS. 3 and 4 another type of electrolytic apparatus modified from that of FIG. 1, in which the flush pipe 13 and the tertiary brine-chlorine gas separating vessel 10 in FIG. 1 are integrated into a single unit. A tertiary separating vessel 110 is formed integrally with a flush pipe 113 through a partition wall 17 whose upper end portion is bored with a single slit 16 or a plurality of apertures (not shown). The brine accumulating space of the tertiary separating vessel 110 communicates directly with that of secondary separating vessel 9 at the lower end. This apparatus of FIGS. 3 and 4 has the same function as that of FIG. 1.

An example of this invention will be described by reference to FIGS. 5 and 6. General referential numeral 201 represents a multiple vertical diaphragm type electrolytic cell constructed by arranging a plurality of (sixteen in this example) unit anode chambers 202 such as those set forth in said U.S. Pat. No. 3,883,415 in a common cathode chamber room 18. The unit anode chamber 202 is surrounded by a diaphragm 19 and a wire net cathode 20, and contains a pair of titanium plate anode electrodes 22 coated with rathenium oxide and so disposed as to face the corresponding diaphragms 19. Referential numeral 21 denotes rod conductors extending from the anode electrodes and connected to a common bus bar (not shown). Referential numeral 203 denotes a primary brine-chlorine gas separating vessel which is connected to the unit anode chambers 202 through corresponding chlorine gas outlet risers 204*a* and brine reflux pipes 204*b*. Each combination of these two pipes 204*a* and 204*b* penetrates the unit anode chamber ceiling the electrolytic cell ceiling and the bottom plate of the primary separating vessel 203. Raw brine is brought into said vessel through a plurality of branch pipes of a brine feeding main pipe 205. Referential numeral 209 denotes a secondary separating vessel. The tip of the downward bent forward end portion of a chlorine gas pipe 206 extending from the chlorine gas accumulating space of the primary separating vessel 203 is dipped into the brine held in the brine accumulating space of the secondary separating vessel 209 to such extent as causes the level of brine received in the brine accumulating space of the primary vessel 203 to be maintained at a height of 100 mm from the bottom thereof. The brine accumulating spaces of the primary and secondary vessels 203 and 209 communicate with each other through a brine connection pipe 207. Referential numeral 210 denotes a tertiary separating vessel 250 mm in diameter. Two brine connection pipes 211 and 212 cause the brine accumulating spaces of the tertiary and secondary separating vessels 210 and 209 to communicate with each other. Referential numerals 213 and 213*a* denote upper and lower flush pipes respectively. The upper flush pipe 213 measures 25 mm in diameter and 1500 mm in length, and the lower flush pipe 213*a* measures 50 mm in diameter and 600 mm in length. General referential numeral 208 represents an automatic pressure control system constituted by a combination of the secondary and tertiary brine-chlorine gas separating vessels 209 and 210.

Figure 5:
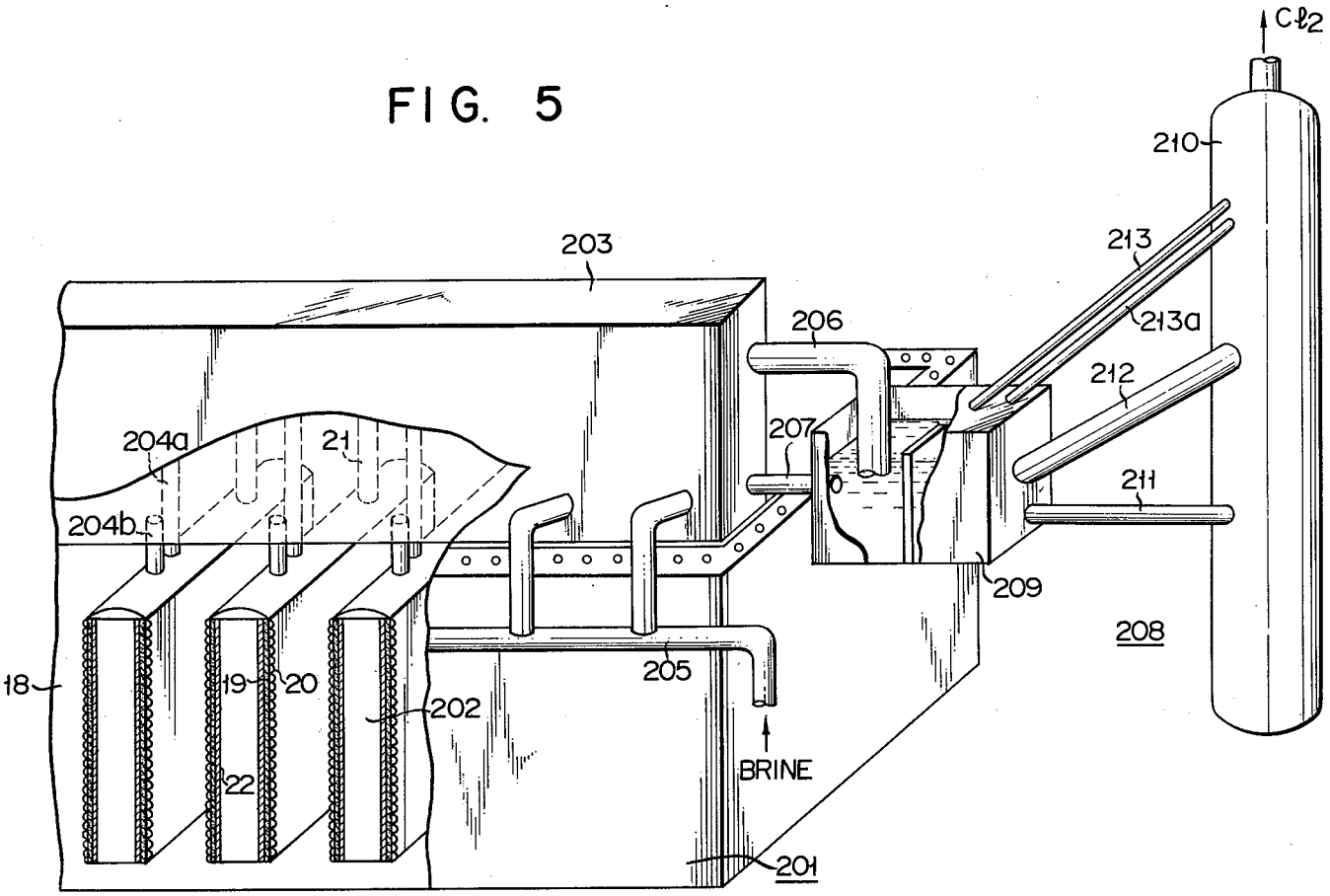
FIG. 5 is an oblique view, partly broken away, of a multiple vertical diaphragm type brine-electrolyzing apparatus of this invention.

With the electrolytic apparatus shown by FIGS. 5 and 6, it was experimentally found that, where electrolyzing ccurrent of 90,000 amperes was introduced, a height from the tip of the downward bent forward end portion of the chlorine gas pipe 206 to the level of brine held in the brine accumulating space of the tertiary separating vessel 210 was maintained at 1,000 mm, said height remained substantially fixed for the same amperage of electrolyzing current, and the pressure of chlorine gas held in the chlorine gas accumulating space of the primary separating vessel 203 presented only small changes falling within the range of ±10 mm of brine head.

Comparative experiments were carried out by omitting the aforesaid automatic pressure control system 208, instead increasing the height or vertical length of the primary separating vessel 203, and controlling the pressure of chlorine gas held in the chlorine gas accumulating space of the anode chamber solely by the head pressure of brine received in the brine accumulating space of said primary separating vessel 203. In this case, the above-mentioned pressure changes became as prominent as ±250 mm of brine head, though said separating vessel having an increased height had a bottom area twice larger than that of the tertiary separating vessel used in any of the preceding example, failing to attain the stable operation of the electrolytic cell.

What we claim is:

1. A vertical diaphragm type electrolytic apparatus for caustic soda production, comprising:

a vertical diaphragm type electrolytic cell having an anode chamber including an anolyte space and a chlorine gas accumulating space above said anolyte space;

a primary brine-chlorine gas separating vessel disposed on said electrolytic cell and provided with a chlorine gas accumulating upper space connected to the chlorine gas accumulating space of the anode chamber through a chlorine gas flow-up pipe connected therebetween, a brine accumulating lower space having a brine reflex pipe of suitable diameter fitted to the bottom of said primary separating vessel so as to keep the level of brine accumulated in said space substantially constant, and a raw brine inlet pipe communicating with said brine accumulating lower space;

a chlorine gas-flow pipe;

a brine-flow pipe;

a secondary brine-chlorine gas separating vessel connected to said primary separating vessel and including a chlorine gas accumulating upper space connected to the chlorine gas accumulating upper space of said primary separating vessel through said chlorine gas-flow pipe, and a brine accumulating lower space connected to the brine accumulating lower space of said primary separating vessel through said brine-flow pipe, the forward end portion of said chlorine gas-flow pipe being dipped into the phase of brine accumulated in the secondary separating vessel;

at least one obliquely rising chlorine gas flush pipe;

at least one further brine-flow pipe; and a tertiary tower type brine-chlorine gas separating vessel connected to the secondary separating vessel and including a chlorine gas accumulating upper space connected to the chlorine gas accumulating space of the secondary separating vessel through said at least one obliquely rising chlorine gas flush pipe, a brine accumulating lower space connected to the brine accumulating lower space of the secondary separating vessel through said at least one further brine-flow pipe, and a chlorine gas outlet provided at the top of the tertiary separating vessel.

2. The electrolytic apparatus of claim 1, wherein the lower end portion of said brine reflux pipe extends into the chlorine gas accumulating space of the anode chamber.

3. The electrolytic apparatus of claim 1, wherein the lower end portion of said brine reflux pipe extends into the anolyte space of the anode chamber.

4. The electrolytic apparatus of claim 1, wherein the tertiary brine-chlorine gas separating vessel is of an inclined tower type constructed integrally with the secondary brine-chlorine gas separating vessel, and the at least one obliquely rising chlorine gas flush pipe is attached to the outer wall of said tertiary separating vessel.

5. The electrolytic apparatus of claim 1, wherein a baffle plate is provided in said secondary separating vessel in front of the lower end of the inlet of the at least one obliquely rising chlorine gas flush pipe so as to prevent scattered particles of brine from being carried into said at least one obliquely rising chlorine gas flush pipe.

6. The electrolytic apparatus of claim 1, wherein said at least one further brine-flow pipe comprises an obliquely rising brine-flow pipe.

7. The electrolytic apparatus of claim 6, wherein said at least one further brine-flow pipe comprises additionally a substantially horizontal brine-flow pipe.

8. The electrolytic apparatus of claim 1, wherein said at least one further brine-flow pipe comprises a substantially horizontal brine-flow pipe.

9. The electrolytic apparatus of claim 5, wherein said baffle plate is located between the inlet of the at least one obliquely rising chlorine gas flush pipe and the outlet of said brine-flow pipe running between said primary and secondary separating vessels.

10. The electrolytic apparatus of claim 9, wherein the outlet of said chlorine gas-flow pipe running between said primary and secondary separating vessels is on the same side of said baffle plate as the outlet of said brine-flow pipe running between said primary and secondary separating vessels.

* * * * *